US006688151B2

(12) United States Patent
Hiura et al.

(10) Patent No.: US 6,688,151 B2
(45) Date of Patent: Feb. 10, 2004

(54) DEVICE AND METHOD FOR SHIFTING WORK ROLL OF CLUSTER MILL

(75) Inventors: Tadashi Hiura, Hiroshima (JP); Youichi Hangai, Hiroshima (JP); Shigefumi Katsura, Chiba (JP); Yoshitake Kohiro, Chiba (JP)

(73) Assignees: Mitsubishi Heavy Industries, Ltd., Tokyo (JP); Kawasaki Steel Corporation, Hyogo (JP)

( * ) Notice: Subject to any disclaimer, the term of this patent is extended or adjusted under 35 U.S.C. 154(b) by 12 days.

(21) Appl. No.: 09/959,963

(22) PCT Filed: Mar. 9, 2001

(86) PCT No.: PCT/JP01/01868

§ 371 (c)(1),
(2), (4) Date: Mar. 4, 2002

(87) PCT Pub. No.: WO01/72443

PCT Pub. Date: Oct. 4, 2001

(65) Prior Publication Data

US 2003/0097866 A1 May 29, 2003

(30) Foreign Application Priority Data

Mar. 27, 2000 (JP) ..... 2000-85818

(51) Int. Cl.[7] ..... B21B 31/18
(52) U.S. Cl. ..... 72/247; 72/13.4
(58) Field of Search ..... 72/242.2, 242.4, 72/237, 241, 9.5, 10.1, 10.7, 245, 13.4

(56) References Cited

U.S. PATENT DOCUMENTS

| | | | | | |
|---|---|---|---|---|---|
| 1,614,612 | A | * | 1/1927 | Hein | 72/247 |
| 2,665,959 | A | * | 1/1954 | Hyams | 384/617 |
| 4,054,043 | A | * | 10/1977 | Eibe | 72/10.6 |
| 4,693,106 | A | * | 9/1987 | Frosch | 72/247 |
| 4,898,014 | A | * | 2/1990 | Ginzburg et al. | 72/13.3 |
| 5,251,502 | A | * | 10/1993 | Eisbrenner et al. | 72/450 |
| 5,448,901 | A | * | 9/1995 | Yu et al. | 700/154 |
| 5,622,073 | A | * | 4/1997 | Hiruta et al. | 72/247 |

FOREIGN PATENT DOCUMENTS

| | | | | | |
|---|---|---|---|---|---|
| DE | DL 0140539 | | * | 3/1980 | B21B/31/18 |
| DE | 37 22 054 | A1 | | 1/1989 | |
| JP | 60115316 | A | * | 6/1985 | B21B/31/18 |
| JP | 0028404 | | * | 6/1986 | B21B/31/18 |
| JP | 61193709 | A | * | 8/1986 | B21B/31/18 |
| JP | 62-3818 | A | | 1/1987 | |
| JP | 62-34908 | | | 3/1987 | |
| JP | 62-161411 | A | | 7/1987 | |
| JP | 0070311 | | * | 3/1990 | B21B/31/18 |
| JP | 2-133108 | A | | 5/1990 | |
| JP | 8-90008 | A | | 4/1996 | |

* cited by examiner

*Primary Examiner*—Allen Ostrager
*Assistant Examiner*—John S Goetz
(74) *Attorney, Agent, or Firm*—Birch, Stewart, Kolasch & Birch, LLP

(57) ABSTRACT

A roll shifting cylinder 14 is driven to pivot a lever arm 12, thereby shifting a work roll 1 via a thrust bearing 15. A control unit 27 performs auto-positioning control, based on a shift amount performance value of the thrust bearing 15 detected by a shift amount detection sensor 16, so as to obtain a target roll shift position. A constant clearance amount is maintained between an end surface of the work roll 1 and the thrust bearing 15 during a rolling operation, and a chockless mill is effectively used as a work roll shift mill.

5 Claims, 12 Drawing Sheets

DEVICE AND METHOD FOR SHIFTING WORK ROLL OF CLUSTER MILL

This application is the national phase under 35 U.S.C. §371 of PCT International Application No. PCT/JP01/01868 which has an International filing date of Mar. 9, 2001, which designated the United States of America.

TECHNICAL FIELD

This invention relates to an apparatus and a method for roll shifting a chockless work roll of a cluster mill.

BACKGROUND ART

A conventional work roll shift apparatus of a cluster mill will be described based on FIGS. 11 and 12. FIG. 11 is a schematic configuration drawing of a cluster mill with 20 rolls which is called a Sendzimir mill, and FIG. 12 is a view taken on line XII—XII in FIG. 11.

The illustrated cluster mill is composed of upper and lower chockless work rolls 50 as a pair, two chocked upper first intermediate rolls 51 and two chocked lower first intermediate rolls 51, three chocked upper second intermediate rolls 52 and three chocked lower second intermediate rolls 52, and four chocked upper backup rolls 53 and four chocked lower backup rolls 53. The numeral 60 denotes a material to be rolled which is passed between the upper and lower work rolls 50.

The cluster mill of the illustrated type is used to roll a stainless steel plate, a nickel-chromium steel plate, etc. It is designed such that the small-diameter, undriven, movable work rolls 50 are held so as to be constrained between the two upper first intermediate rolls 51 and the two lower first intermediate rolls 51, and the movement of the work roll 50 in the axial direction is restrained by a thrust bearing provided at a position opposed to the end of the work roll 50.

FIG. 12 shows an end portion of the work roll 50 of the cluster mill. In the drawing, 50*a* denotes an end flange of the work roll 50, and 51*a* denotes a chock of the first intermediate roll 51. The work roll 50 is provided so as to have a length with which the end flange 50*a* is located deep near the inside of the chock 51*a* of the first intermediate roll 51. At this position, a revolving thrust bearing 54 is provided which spreads over the two (upper and lower) end flanges 50*a* in such a manner as to be opposed to the outer surfaces of the end flanges 50*a* with a slight clearance. Thus, the axial movement of the work rolls 50 is suppressed by the thrust bearing 54.

In the illustrated cluster mill, in order to facilitate the withdrawal and replacement of the work roll 50 suffering from marked wear and tear, the thrust bearing 54 is supported on the ends of rods of a pair of cylinders 55, whereby the work rolls 50 are moved together with the thrust bearing 54 over a certain distance as shown by chain lines in the drawing.

With a chocked work roll mill having a small number of rolls, for example, for hot rolling of a steel material, a roll shifting configuration for shifting upper and lower chocked work rolls in the axial direction has found use as a method for control of a plate surface shape during rolling.

With the cluster mill shown in FIGS. 11 and 12, on the other hand, the work roll 50 has a chockless structure and is undriven. Thus, roll shift by a mechanical structure as in the hot rolling mill is not applicable, and a work roll shift apparatus for cluster mills has not been under development.

The present invention has been accomplished in light of the above-described circumstances, and its object is to provide a work roll shift apparatus and a work roll shift method which can be put to practical use in the cluster mill.

DISCLOSURE OF THE INVENTION

A work roll shift apparatus for a cluster mill according to the present invention is a work roll shift apparatus adapted to shift a chockless work roll of the cluster mill having the chockless work rolls, characterized by:

- lever arms each supported at one end by a chock of rolls adjacent to the chockless work roll, and provided so as to be horizontally pivotable about a line perpendicular to an axis line of the work roll as a neutral point;
- roll shifting cylinders each connected to the lever arm so as to pivot the lever arm;
- thrust bearings each provided on the lever arm and opposed to an end of the work roll;
- shift amount detecting means each provided in the chock of the rolls for detecting a shift amount of the thrust bearing; and
- a control unit for driving the roll shifting cylinder so as to maintain a clearance between the work roll and the thrust bearings and obtain a target roll shift position based on a shift amount performance value of the thrust bearing obtained by the shift amount detecting means.

According to this feature, a chockless mill, such as a Sendzimir mill or other cluster mill, can be effectively used as the work roll shift mill. Moreover, shift control of the upper and lower work rolls takes place by different routes, so that the upper and lower shift positions can be set freely. For example, shift of the upper and lower work rolls in opposite directions in response to changes in the plate width, or shift of the upper and lower work rolls in the same direction following a zigzag motion of the plate can be freely set and performed.

The work roll shift apparatus for a cluster mill is also characterized in that the lever arm is composed of a frame structure having insert-through holes through which the rolls are inserted so as to be freely fitted with play; that the work roll is composed of a tapered roll; and that the work roll is composed of a tapered roll.

A work roll shift method for a cluster mill according to the present invention is a work roll shift method for a cluster mill, adapted to shift a chockless work roll in a required shift amount by possessing thrust bearings opposed to both ends of the chockless work roll so as to be capable of being relieved or pushed in by shifting cylinders, securing a constant clearance between the ends of the work roll and the thrust bearings, and blocking the shifting cylinder, characterized by:

- multiple-dividing the required shift amount of the work roll to set short shift amounts as units;
- performing a relief action for one of the thrust bearings and a push-in action for the other thrust bearing in each short shift amount, based on a shift amount performance value of the thrust bearing, so as to obtain a target roll shift position;
- then blocking the shifting cylinder; and
- repeating shift in each short shift amount and a blocking action for the shifting cylinder to shift the work roll in the required shift amount.

According to this feature, the effect that the chockless work roll of the cluster mill can be roll-shifted safely and highly precisely can be obtained.

BEST MODE FOR CARRYING OUT THE INVENTION

To describe the present invention in greater detail, the accompanying drawings will be complied with.

A first embodiment of the present invention will be explained based on FIGS. 1 to 5.

Figure 1:
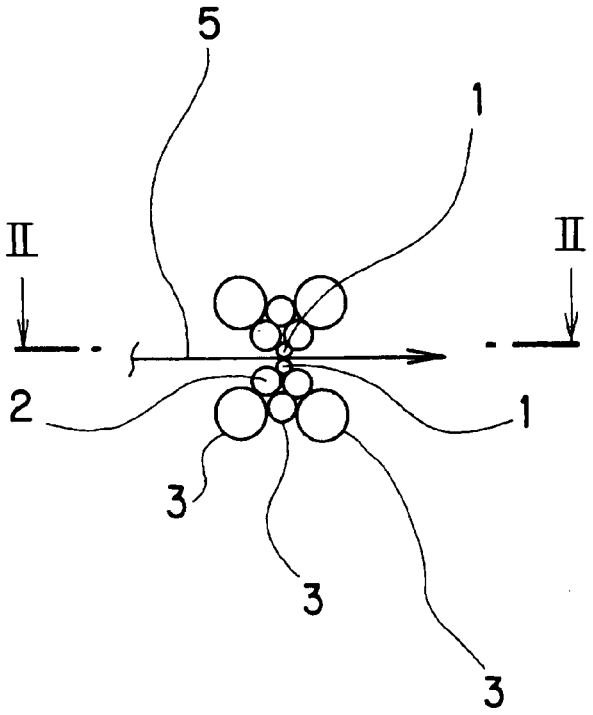
FIG. 1 is a schematic configuration drawing of a cluster mill to which a work roll shift apparatus according to a first embodiment of the present invention is applied.

In FIG. 1, the cluster mill has a 12-roll configuration including upper and lower chockless work rolls 1 as a pair, two upper and two lower intermediate rolls 2, as chocked rolls, appended to (adjacent to) the upper and lower work rolls 1, and three upper and three lower chocked backup rolls 3. A material 5 to be rolled is passed between the work rolls 1.

Figure 2:
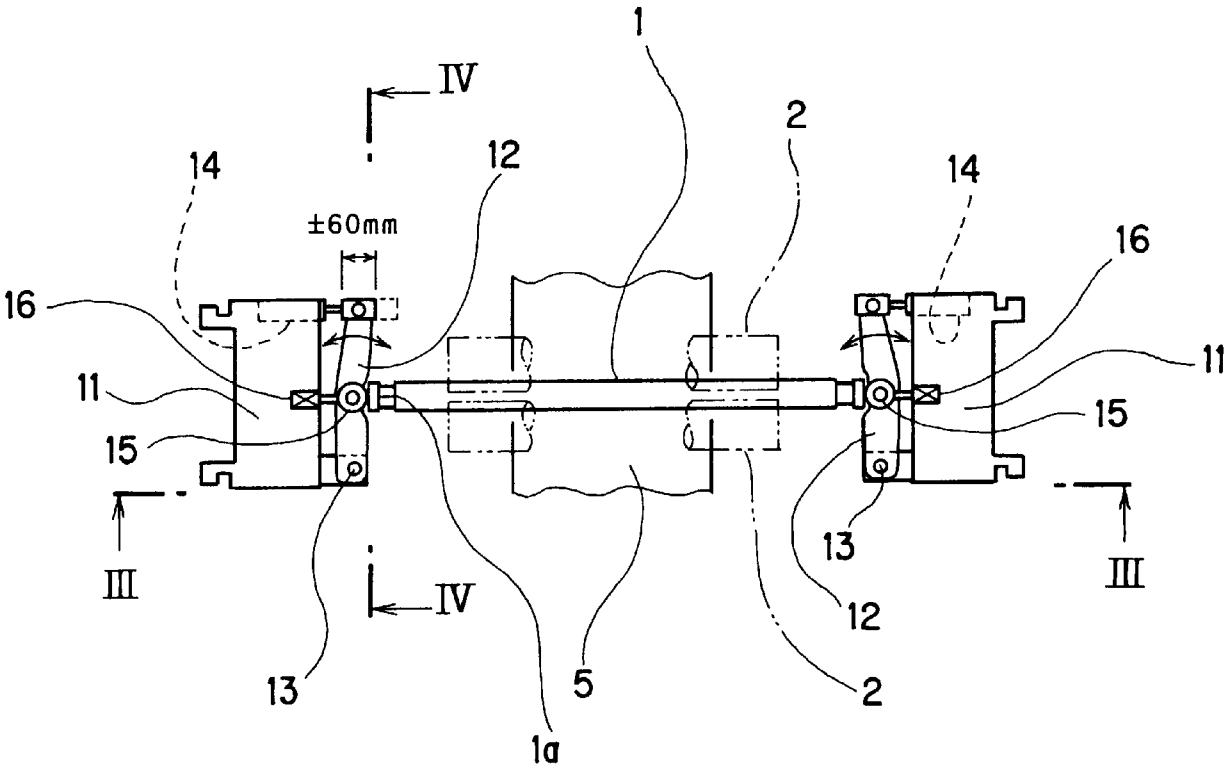
FIG. 2 is a view taken on line II—II in FIG. 1.
Figure 3:
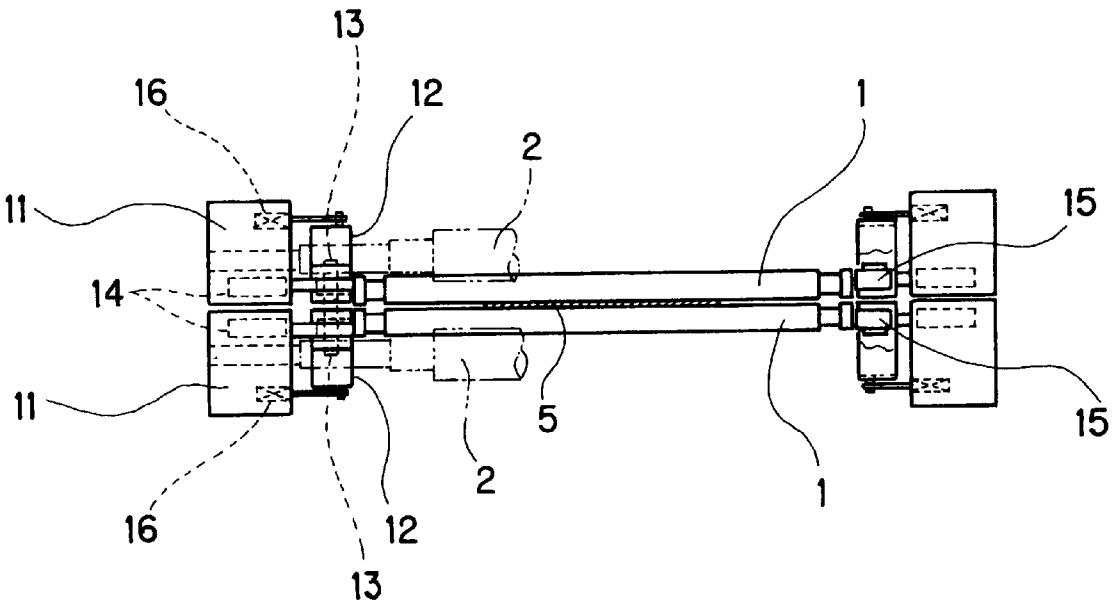
FIG. 3 is a view taken on line III—III in FIG. 2.

As shown in FIGS. 2 and 3, one end of a lever arm 12 is horizontally pivotably supported on a surface of a chock 11 of the intermediate roll 2 (see FIG. 1) facing the line center via a hinge shaft 13, and a roll shifting cylinder 14 is provided in the chock 11. The other end of the lever arm 12 is bonded to a rod of the roll shifting cylinder 14, and the lever arm 12 is pivoted by driving of the roll shifting cylinder 14 via the hinge shaft 13.

Figure 4:
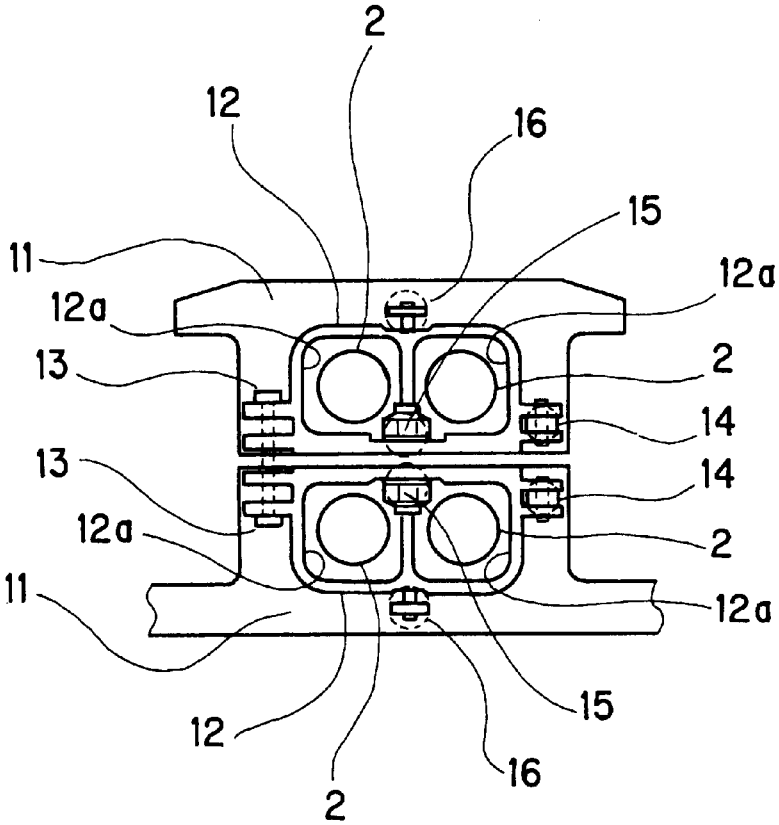
FIG. 4 is a view taken on line IV—IV in FIG. 2.

As shown in FIGS. 3 and 4, the lever arm 12 is composed of a frame structure having insert-through holes 12*a* through which the intermediate rolls 2 are inserted so as to be freely fitted with play, namely, a spectacle frame allowing the intermediate rolls 2 to pass therethrough loosely. On a side of the lever arm 12 facing the line center, a thrust bearing 15 is provided at a site opposed to an end flange 1*a* of the work roll 1 such that a circumferential portion of the thrust bearing 15 slightly juts out. A shift amount detection sensor 16, as shift amount detecting means for detecting the shift amount of the thrust bearing 15, is mounted on a central upper part of the chock 11 for the intermediate rolls 2. A movable end of the shift amount detection sensor 16 is connected to the central part of the lever arm 12.

The configuration of a hydraulic circuit of the roll shifting cylinder 14 will be described based on FIG. 5. The hydraulic circuit of the roll shifting cylinder 14 is provided in the same configuration for each of the upper and lower work rolls 1, and FIG. 5 shows one of the work rolls 1 and its hydraulic circuit.

Figure 5:
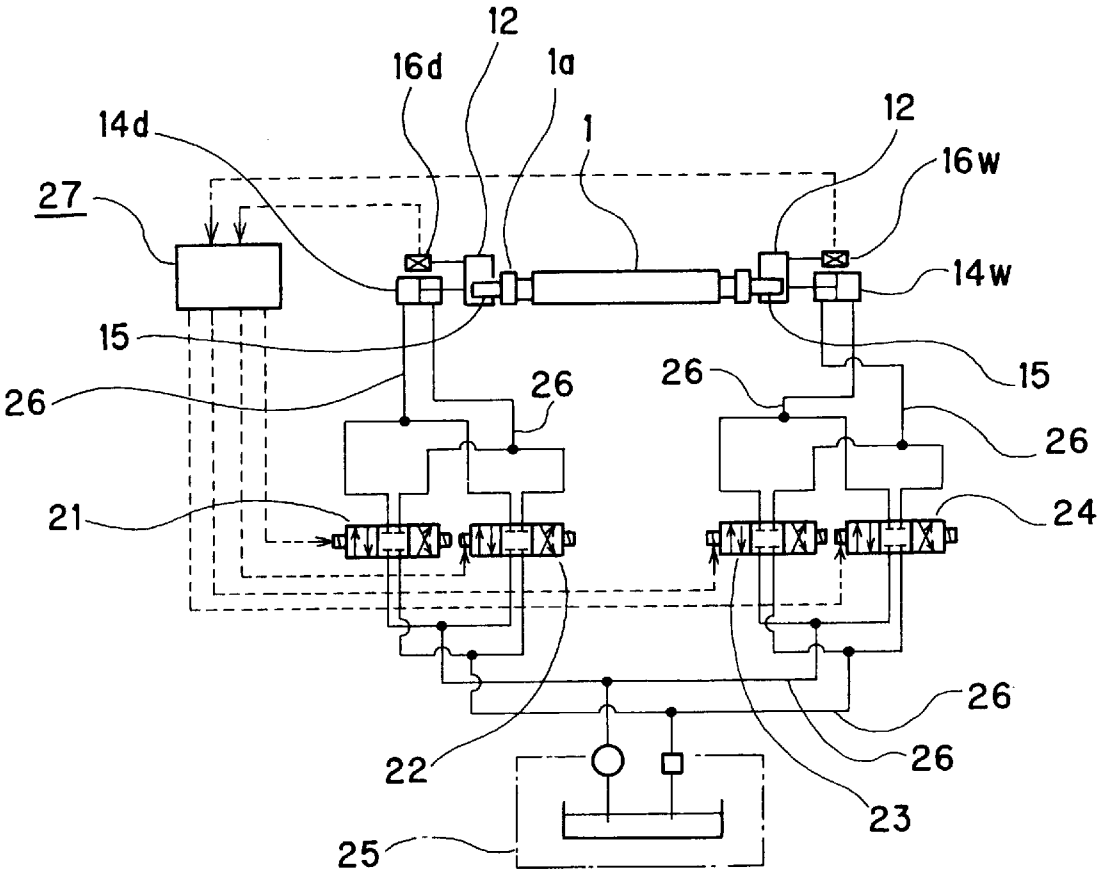
FIG. 5 is a hydraulic circuit diagram of work roll shifting cylinders.

Of the numerals in FIG. 5, 14*d* and 14*w* denote roll shifting cylinders for the work roll 1 corresponding to the drive side and the work side of the cluster mill shown in FIG. 1, and 16*d* and 16*w* denote shift amount detection sensors for detecting the shift amounts of the thrust bearings 15 on the drive side and the work side.

The hydraulic circuit is composed of two electromagnetic selector valves 21 and 22 for driving in an extending manner (hereinafter referred to as push drive or driving) or driving in a contracting manner (hereinafter referred to as relief drive or driving) the drive-side roll shifting cylinder 14*d*, two other electromagnetic selector valves 23 and 24 for push or relief driving the work-side roll shifting cylinder 14*w*, a pipe line 26 for connecting a hydraulic pressure supply source 25 to the head side and the rod side of the roll shifting cylinders 14*d* and 14*w* via the electromagnetic selector valves 21 to 24, and a control unit 27 for controlling the electromagnetic selector valves 21 to 24 based on detection signals from bearing shift amount detection sensors 16*d*, 16*w* arranged on the drive side and the work side, thereby performing auto-positioning control of the shift amounts.

The above work roll shift apparatus has been described in connection with the chockless work roll 1, but chocked work rolls are similarly applicable by replacing the thrust bearings 15 by thrust cups. Also, the thrust bearing 15 is attached to the lever arm 12, but may be attached directly to the roll shifting cylinder 14.

The actions of the work roll shift apparatus in the above configuration will be described.

The cluster mill has a structure in which both sides of the work roll 1 are received by the thrust bearings 15. Thus, when the thrust bearings 15 are fixed in contact with both sides of the work roll 1, a strong thrust force is imposed on the work roll 1 during a rolling operation, whereby the thrust bearing 15 may be broken.

According to the work roll shift apparatus of the present embodiment, the lever arm 12 is pivoted by driving the roll shifting cylinder 14 to shift the work roll 1 via the thrust bearing 15. At this time, the control unit 27 performs auto-positioning control based on the shift amount performance values of the thrust bearings 15 detected by the shift amount detection sensors 16 so that the target roll shift position will be obtained, thereby retaining a constant clearance amount between the end surface of the work roll 1 and the thrust bearing 15 during the rolling operation.

Simultaneously, the upper and lower work rolls 1 are individually roll-shifted, with this constant clearance maintained. That is, one of the roll shifting cylinders 14*d* and 14*w* on the drive side and the work side is relief-driven, and the other of them is push-driven synchronously for each of the upper and lower work rolls 1 via the electromagnetic selector valves 21 to 24 in accordance with manipulation by the control unit 27. As a result, the upper and lower work rolls 1 are roll-shifted in opposite directions.

The thrust force exerted between the end of the work roll 1 and one of the right and left thrust bearings 15 during operation is received after being cushioned by the hydraulic force of the roll shifting cylinder 14. Thus, there is no damage to the thrust bearing 15.

As described above, the above-mentioned configuration makes it possible to provide the work roll shift apparatus that can effectively use a chockless mill, such as a Sendzimir mill or other cluster mill, as the work roll shift mill. Moreover, shift control of the upper and lower work rolls 1 takes place by different routes, so that the upper and lower shift positions can be set freely. For example, shift of the upper and lower work rolls in opposite directions in response to changes in the plate width, or shift of the upper and lower work rolls in the same direction following a zigzag motion of the plate can be freely set and performed.

Figure 6:
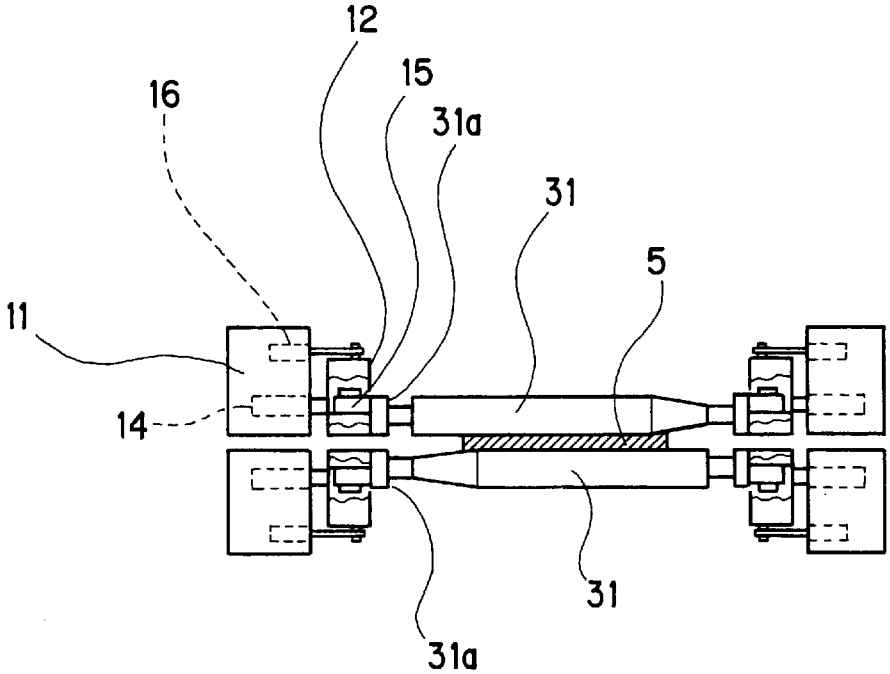
FIG. 6 is a schematic side view of a cluster mill to which a work roll shift apparatus according to a second embodiment of the present invention is applied.

A second embodiment of the present invention will be described based on FIG. 6. The same members as the members shown in FIGS. 1 to 5 will be assigned the same numerals, and duplicate descriptions omitted.

The present embodiment indicates the construction of a work roll shift apparatus using tapered rolls, which have an excellent plate surface shape control effect by roll shift, as work rolls of a cluster mill. In FIG. 6, the numeral 31 denotes a tapered work roll as the work roll, and a pair of the tapered work rolls 31 as the upper and lower work rolls are arranged so as to have the tapers positioned in opposite directions, with end flanges 31*a* being provided on both sides. A roll shift mechanism is the same as the constitution shown in FIGS. 1 to 5.

When the tapered work roll 31 is used, a better plate surface shape control effect is obtained by an action ascribed to the structural properties of the tapered work roll 31 itself. Other actions and effects are the same as shown in FIGS. 1 to 5.

Next, a work roll shift method by the above-described work roll shift apparatus will be concretely described based on FIGS. 7 to 10(*a*), 10(*b*).

When work roll shift of a cluster mill is to be carried out using the work roll shift apparatuses of the first embodiment and the second embodiment, the work roll 1 and the tapered work roll 31 (hereinafter referred to simply as the work roll 1) have a chockless structure, so that shift of the work roll 1 is performed by driving the work-side or drive-side roll shifting cylinder 14*w* or 14*d* of the mill to push in the work roll 1 by the thrust bearing 15.

In performing a work roll shift operation, since the work-side and drive-side thrust bearings 15 are not mechanically bonded, there can be produced a state in which both thrust bearings 15 mechanically sandwich the work roll 1 from its opposite ends. This state imposes a high load within the thrust bearings 15, and thus is undesirable. To prevent this sandwiching in a controlled manner, a shift action is performed, with a predetermined total amount (e.g., 3 mm at a minimum) of clearance being secured between the work roll 1 and the thrust bearings 15 on both sides.

With the actual work roll shift, the upper and lower work rolls 1 need to be roll-shifted within ranges of predetermined amounts (e.g., ranges of about ±65 mm) during a rolling operation. When the work roll 1 shown in FIG. 5 is to be shifted rightward, relief drive of the right-hand thrust bearing 15 by the right-hand roll shifting cylinder 14*w* and push drive of the left-hand thrust bearing 15 by the left-hand roll shifting cylinder 14*d* are performed in parallel. By so doing, the clearance between the work roll 1 and the thrust bearing 15 may be narrowed, for example, because of the operating time difference between the right and left roll shifting cylinders 14*w* and 14*d*, to catch the work roll 1 between the right and left roll shifting cylinders 14*w* and 14*d*. To avoid this situation, the relief drive by the right-hand roll shifting cylinder 14*w* may be carried out first, and then the push drive by the left-hand roll shifting cylinder 14*d* may be performed. With this method, if the relief amount of the forerunning right-hand thrust bearing 15 is great, the clearances between the work roll 1 and both thrust bearings 15 instantaneously widen. As a result, the work roll 1 sideslips, causing a poor plate surface shape of the welded material.

Figure 7:
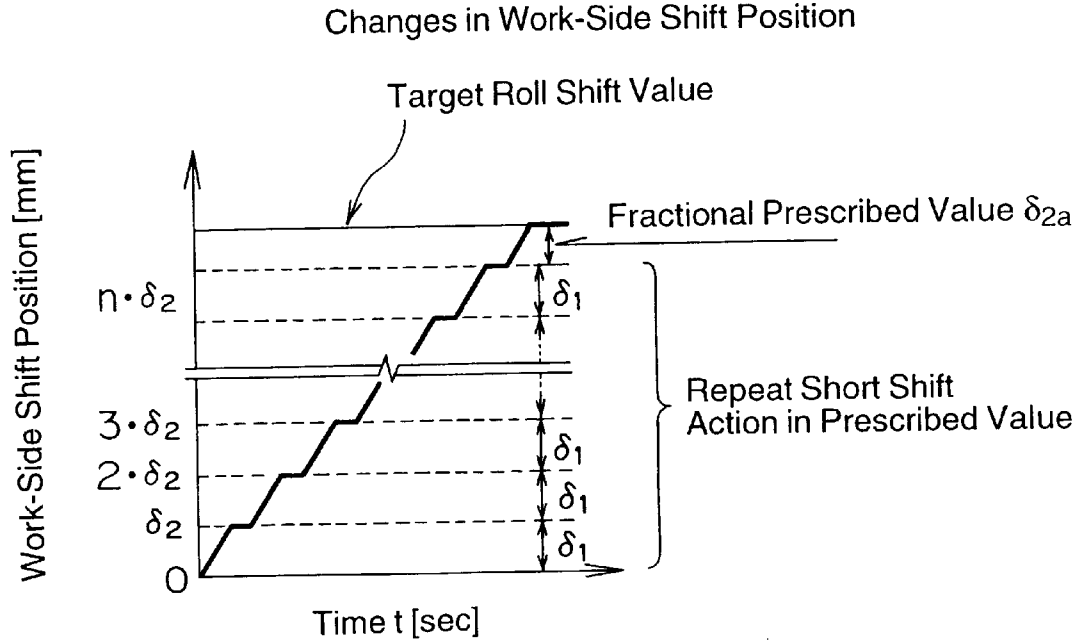
FIG. 7 is a graph showing the concept of a work roll shift method in the cluster mills of the first embodiment and the second embodiment.

To prevent this problem, the present invention controls the roll shifting cylinders 14*w*, 14*d* by the auto-positioning control that controls the roll shifting cylinders 14*w*, 14*d* so as to reduce the difference between the detected position as the shift amount performance value and the target roll shift position (target roll shift value) while detecting the actual shift positions of the thrust bearings 15 with the shift amount detection sensors 16*w*, 16*d* at the time of roll shifting. As shown in FIG. 7, moreover, the target roll shift value of the work roll 1 is divided into a plurality of short shift sections $\delta_2$ to $n \cdot \delta_2$, and relief of the right-hand thrust bearing 15, and pushing-in of the left-hand thrust bearing 15 are repeated by short shifts of the divisional prescribed values $\delta_2$. Moreover, a fractional prescribed value $\delta_2$a, which is a prescribed amount over the finally remaining fractional distance to the target roll shift value, is taken as the final short shift target value, and terminal processing is performed by short shift using the final short shift target value.

$\delta_1$, shown in FIG. 7, is the shift amount performance value (performance value) of the actual short shift position (distance) found when the result of the short shift operation performed with the prescribed value $\delta_2$ being set as the target value for a single shift was detected with the shift amount detection sensors 16*w*, 16*d*. $\delta_2$a is a fractional prescribed value which is smaller than the prescribed value $\delta_2$, and which is left finally until a roll shift target value line (target roll shift value) is reached after shift operations of the performance value $\delta_1$ for the short shift are repeated.

Figure 8:
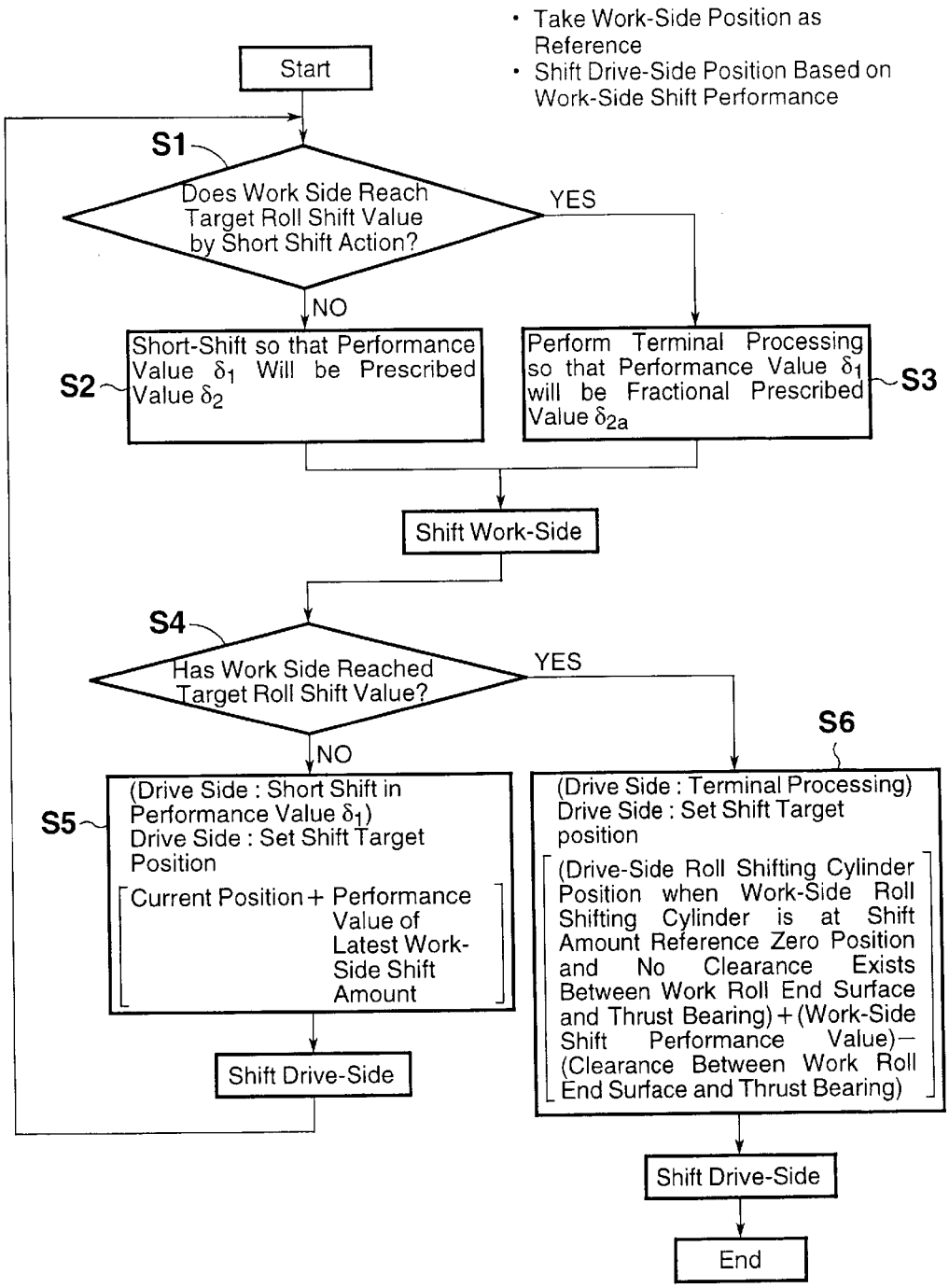
FIG. 8 is a basic flow chart of roll shift actions.

FIG. 8 is a basic flow of roll shift control of the chockless work roll performed by this method. FIG. 8 shows a case in which one of the upper and lower work rolls 1 is shifted toward the work side (the right side in FIG. 5). Whereas the other work roll 1 is separately shifted in the same or opposite direction according to the same flow.

Shift control of the chockless work roll is carried out in accordance with the following procedure:

[Step 1]

When operation of the mill is started, the roll shifting cylinders 14*w*, 14*d* are blocked first. That is, during a steady operation of the mill, an internal pressure is applied to the roll shifting cylinders 14*w*, 14*d*, with a clearance of, for example, 3 mm being secured between the work roll 1 and the thrust bearings 15, to block (enclose) the roll shifting cylinders 14*w*, 14*d*.

[Step 2]

Then, at the time of work roll shift, it is checked, before entry into a short shift action, "whether the work side reaches the target roll shift value by the current shift action?"(S1). Namely, it is examined whether the "target roll shift value" of FIG. 7 is reached when the work roll 1 is moved by the prescribed value $\delta_2$. If "the target roll shift value is not reached," the work-side roll shifting cylinder 14*w* is short-shifted by auto-positioning control so that the performance value $\delta_1$ will become the prescribed value $\delta_2$ with the prescribed value $\delta_2$ as the target position, whereafter the work-side roll shifting cylinder 14*w* is blocked (S2). If "the target roll shift value is reached," the remaining fractional prescribed value $\delta_2$a is calculated by the control unit 27, and the work-side roll shifting cylinder 14*w* is short-shifted by auto-positioning control, with the remaining fractional prescribed value $\delta_2$a as the target position, so that the performance value $\delta_1$ will become the fractional prescribed value $\delta_2$a, whereafter the work-side roll shifting cylinder 14*w* is blocked (S3).

[Step 3]

Then, it is checked whether "the accumulation of the performance values $\delta_1$'s on the work side has amounted to the target roll shift value?" (S4). If the result of checking is NO, a short shift order for the performance value $\delta_1$ is issued to the drive side, and the drive-side roll shifting cylinder 14*d* is short-shifted by auto-positioning control, with [the current position+the performance value $\delta_1$ of the work-side shift amount] as the target position, whereafter the drive-side roll shifting cylinder 14*d* is blocked at this position (S5). Then, [Step 2] is resumed again, and the same processing procedure is repeated.

Figures 9A, 9B:
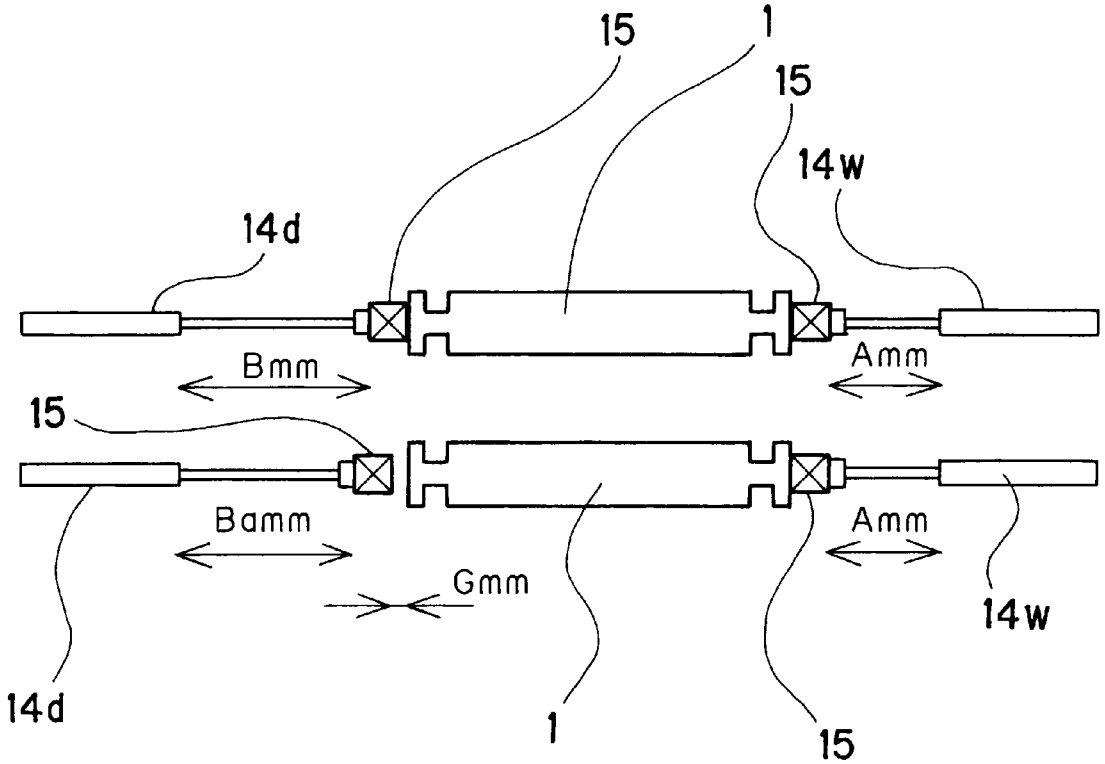
FIGS. 9(*a*) and 9(*b*) are explanation drawings of the principle of position control.

The position control with [the current position+the performance value $\delta_1$ of the work-side shift amount] as the target position will be described with reference to FIGS. 9(*a*), 9(*b*) and 10(*a*), 10(*b*). FIGS. 9(*a*), 9(*b*) and 10(*a*), 10(*b*) illustrate the principle of position control, and show the situation of the roll shifting cylinders 14 and the thrust bearings 15 lying on the same straight line for convenience's sake. Actually, however, the distance from the hinge shaft 13 to the rod support fulcrum of the roll shifting cylinder 14 and the distance from the hinge shaft 13 to the thrust bearing 15 are in the 2:1 relationship, as shown in FIG. 2. As seen from FIG. 2, the shift amount detection sensor 16 and the roll shifting cylinder 14 do not exit on the same axis line. Thus, if an instruction is given to the roll shifting cylinder 14 based on the performance value $\delta_1$ detected by the shift amount detection sensor 16, there is a concern that the clearance between the end surface of the work roll 1 and the thrust bearing 15 cannot be set optimally because of an error or the like. Hence, position control of the thrust bearing 15 is performed in the manner described below.

First, the relief-side thrust bearing 15 (work side) is axially moved. Then, the push-side thrust bearing 15 (drive side) is axially moved based on the movement performance of the relief-side thrust bearing 15. Here, in the absence of a clearance between the end surface of the work roll 1 and the thrust bearing 15, let the rod length of the work-side roll shifting cylinder 14*w* be A (mm), and the rod length of the drive-side roll shifting cylinder 14*d* be B (mm), as shown in FIG. 9(*a*). The sum L of the rod lengths when the optimal clearance G (mm) is retained is L=A+B−G, so that the rod length of the drive-side roll shifting cylinder 14*d* is Ba (mm), as shown in FIG. 9(*b*).

The sum of the rod lengths, L=A+B−G, eliminates the influence of an error in the length of the work roll 1 on the above clearance G.

Figure 10A:
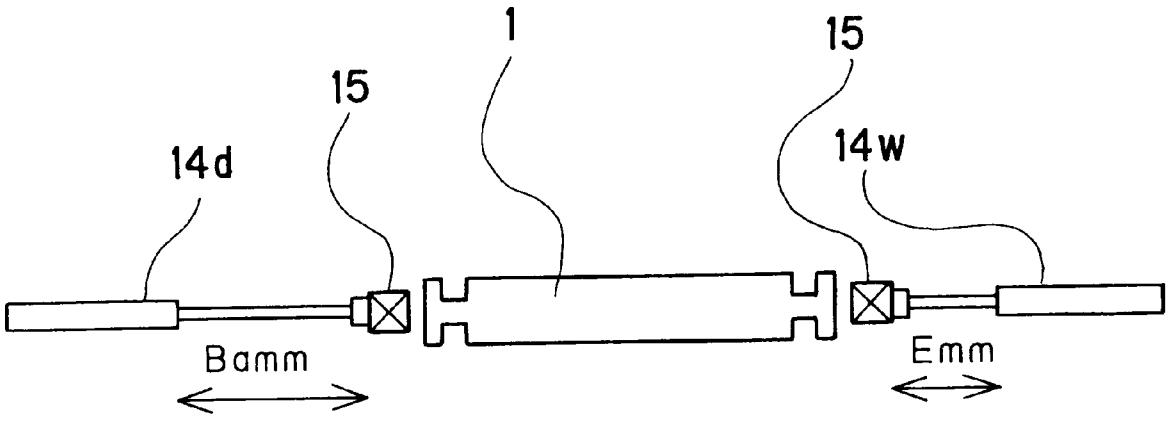
FIGS. 10(*a*) and 10(*b*) are explanation drawings of the principle of position control.
Figure 10B:
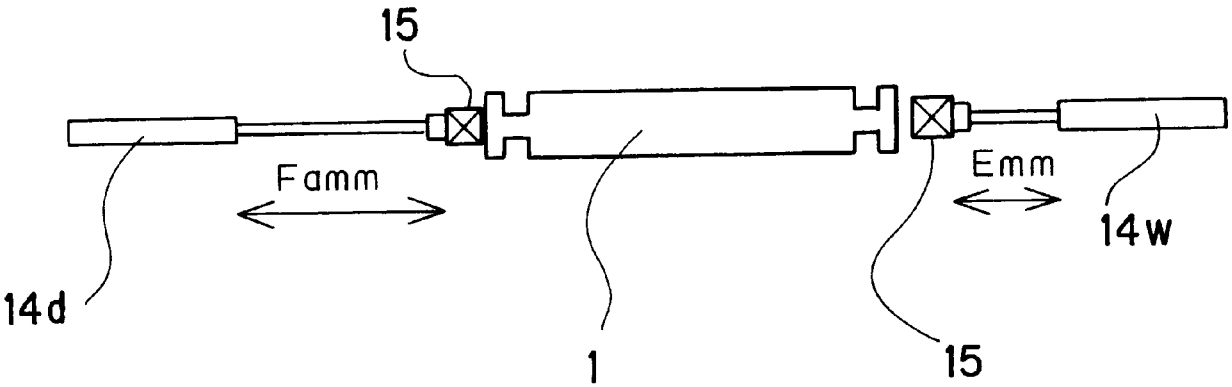
Figure 11:
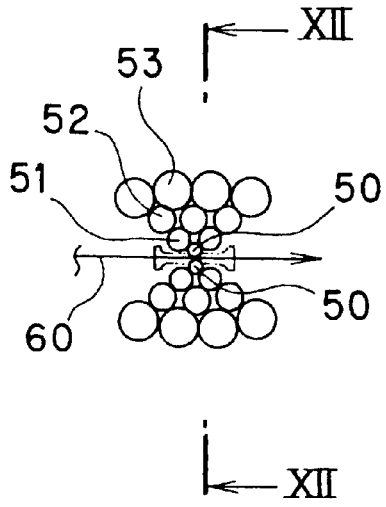
FIG. 11 RELATED ART
FIG. 11 is a schematic configuration drawing of a cluster mill with 20 rolls called a Sendzimir mill.
Figure 12:
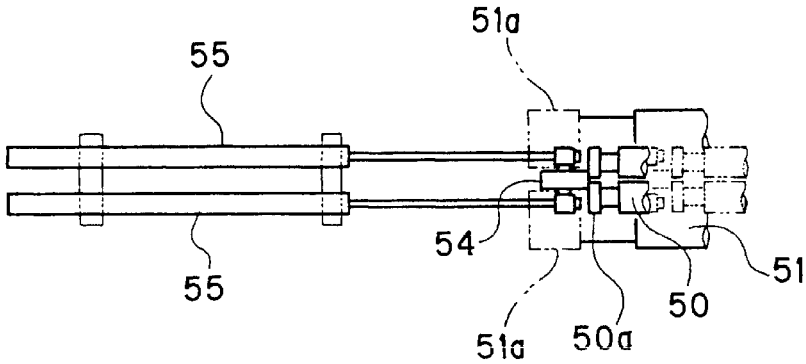
FIG. 12 RELATED ART
FIG. 12 is a view taken on line XII—XII in FIG. 11.

When movement is to be performed with the prescribed value $\delta_2$ from the state of FIG. 9(*b*), the work-side roll shifting cylinder 14*w* is moved in the relief direction with a movement performance E (mm), as shown in FIG. 10(*a*). The push-side thrust bearing 15 moves the drive-side roll shifting cylinder 14*d* in the push direction based on the movement performance E (mm), as shown in FIG. 10(*b*). The command value F at this time is L−E, and the drive-side roll shifting cylinder 14*d* moves with a movement performance Fa.

In actuality, roll shift is mediated by the lever arm 12. Thus, the performance value $\delta_1$ detected by the work-side shift amount detection sensor 16*w* in the state of FIG. 10(*a*) is $\delta_1$=(A−E)/2, i.e., $2\delta_1$=A−E, while the performance value $\delta_1$ in the drive-side shift amount detection sensor 16*d* in the state of FIG. 10(*b*) is $\delta_1$=(F−Ba)/2, i.e., $2\delta_1$=F−Ba. As seen from FIG. 2, the distance from the hinge shaft 13 to the rod support fulcrum of the roll shifting cylinder 14 and the distance from the hinge shaft 13 to the thrust bearing 15 are in the 2:1 relationship. Thus, $2\delta_1$=A−E and $2\delta_1$=F−Ba.

If the result of checking in S4 is YES, on the other hand, an order for "terminal processing" is issued to the drive side. As a result, the drive-side roll shifting cylinder 14*d* is short-shifted by auto-positioning control, with [B+the performance value (A−E) of the work-side shift amount−the clearance (G) between the end surface of the work roll 1 and the thrust bearing 15] as the shift target position, whereafter the drive-side roll shifting cylinder 14*d* is blocked at this position (S6). In this manner, the shift operation is completed.

According to the above-described work roll shift method, the chockless work roll 1 (tapered work roll 31) of the cluster mill gains a required shift amount, because the relief of the shift-side thrust bearing 15 and the push of the reverse-side thrust bearing 15 are accurately repeated by the operation in many divisional short shift amounts and under auto-positioning control during the shifting process in the necessary shift amount for plate surface control of the material 5 to be rolled.

During shift of the chockless work roll 1, therefore, a large clearance is no more existent between the ends of the work roll 1 and the thrust bearing 15, so that sideslip of the work roll 1 is eliminated. Furthermore, the shift action is repeated under auto-positioning control after securing clearance of a predetermined amount (e.g., 3 mm), as a sum of right and left clearances, between the ends of the work rolls 1 and the thrust bearings 15. Thus, the phenomenon that the right and left thrust bearings 15 catch the work roll 1 therebetween during roll shift does not occur any more.

Hence, the effect that the chockless work roll 1 of the cluster mill or the like can be roll-shifted safely and highly precisely can be obtained.

INDUSTRIAL APPLICABILITY

As described above, a chockless mill, such as a Sendzimir mill or other cluster mill, can be effectively utilized as a work roll shift mill. Furthermore, shift control of the upper and lower work rolls is performed by different systems. Thus, the shift positions of the upper and lower work rolls can be set freely. For example, shift of the upper and lower work rolls in opposite directions in response to changes in the plate width, or shift of the upper and lower work rolls in the same direction following a zigzag motion of the plate can be freely set and performed.

What is claimed is:

1. A work roll shift apparatus for a cluster mill, adapted to shift a chockless work roll of the cluster mill having the chockless work rolls, comprising:

lever arms each supported at one end by a chock of rolls adjacent to the chockless work roll, and provided so as to be horizontally pivotable about a line perpendicular to an axis line of the work roll;

roll shifting cylinders each connected to a lever arm so as to pivot the lever arm;

thrust bearings each provided on a lever arm and opposed to an end of the work roll;

shift amount detecting means each provided in the chock of the rolls for detecting a shift amount of the thrust bearing; and a control unit for driving the roll shifting cylinder so as to maintain a clearance between the work roll and the thrust bearings and obtain a target roll shift position based on a shift amount performance value of the thrust bearing obtained by the shift amount detecting means.

2. A work roll shift apparatus for a cluster mill as claimed in claim 1, wherein the lever arms are composed of a frame structure having insert-through holes through which the rolls are inserted so as to be freely fitted with play.

3. A work roll shift apparatus for a cluster mill as claimed in claim 1, wherein the work roll is composed of a tapered roll.

4. A work roll shift apparatus for a cluster mill as claimed in claim 2, wherein the work roll is composed of a tapered roll.

5. A work roll shift method for a cluster mill, adapted to shift a chockless work roll a required shift amount, said cluster mill including thrust bearings opposed to both ends of the chockless work roll so as to be capable of being relieved or pushed in by shifting cylinders, securing a constant clearance between the ends of the work roll and the thrust bearings, and blocking each shifting cylinder, comprising steps of:

multiple-dividing the required shift amount of the work roll to set short shift amounts as units;

performing a relief action for one of the thrust bearings and a push-in action for the other thrust bearing in each short shift amount, based on a shift amount performance value of the thrust bearing, so as to obtain a target roll shift position;

then blocking each shifting cylinder; and repeating performance of said relief action and said push-in action in each short shift amount and a blocking action for each shifting cylinder to shift the work roll the required shift amount.

* * * * *